US006636160B2

(12) United States Patent
Brei

(10) Patent No.: US 6,636,160 B2
(45) Date of Patent: Oct. 21, 2003

(54) TRANSIT INFORMATION DISPLAY SYSTEM

(75) Inventor: Randy Brei, Woodbridge, VA (US)

(73) Assignee: Siemens Transporation Systems, Inc., Sacramento, CA (US)

( * ) Notice: Subject to any disclaimer, the term of this patent is extended or adjusted under 35 U.S.C. 154(b) by 229 days.

(21) Appl. No.: 09/884,895

(22) Filed: Jun. 19, 2001

(65) Prior Publication Data

US 2002/0071414 A1 Jun. 13, 2002

Related U.S. Application Data

(60) Provisional application No. 60/212,692, filed on Jun. 19, 2000.

(51) Int. Cl.[7] ..... G08G 1/123

(52) U.S. Cl. ..... 340/994; 345/589; 345/619; 345/581; 345/647; 345/649; 345/660; 345/744; 701/200

(58) Field of Search ..... 360/994; 701/200; 345/123, 568, 589, 649, 660, 744, 647, 619, 581, 684

(56) References Cited

U.S. PATENT DOCUMENTS 4,648,046 A * 3/1987 Copenhaver et al. ..... 345/589
5,734,852 A * 3/1998 Zias et al. ..... 345/744
5,734,875 A * 3/1998 Cheng ..... 345/568
5,761,625 A 6/1998 Honcik et al. ..... 701/14
5,944,659 A 8/1999 Flach et al. ..... 600/300
5,987,377 A 11/1999 Westerlage et al. ..... 701/204
6,150,955 A 11/2000 Tracy et al. ..... 340/870.02
6,213,942 B1 4/2001 Flach et al. ..... 600/300
6,297,795 B1 * 10/2001 Kato et al. ..... 345/684
6,374,176 B1 * 4/2002 Schmier et al. ..... 701/200
6,549,214 B1 * 4/2003 Patel et al. ..... 345/660

* cited by examiner

*Primary Examiner*—Benjamin C. Lee

(57) ABSTRACT

A time division multiple access (TDMA) based transit information display communications system having an information display is disclosed. The information display includes an electronic display area, a microcontroller supported by the information display and coupled to the display, a radio frequency receiver coupled to the microcontroller, a memory coupled to the microcontroller, and a program running on the microcontroller, the program being stored in the memory, the program being configured to display data on the display according to configuration data including an information display identification (ID) and the number of lines in the display.

31 Claims, 2 Drawing Sheets

TRANSIT INFORMATION DISPLAY SYSTEM

REFERENCE TO RELATED APPLICATIONS

This application claims the benefit of U.S. Provisional Application No. 60/212,692, filed Jun. 19, 2000, the entirety of which is herein incorporated by reference.

BACKGROUND

Historically, transit systems such as local bus systems utilize scheduled routes to pick up and drop off passengers throughout the day. Passengers utilizing the transit systems are not conventially apprised as to the arrival time, departure time, and other information relating to the individual vehicle on the route or the transit system as a whole. In order to accommodate the delivery of such information, information systems have been deployed and distributed along the routes. The information systems typically include an information display providing a schedule of when a bus or other transit vehicle should be arriving. Many of these transit information systems may be static systems in which a schedule is not updated for real time events such as delays. However, other information systems are used in which the schedule information that is provided to a potential passenger is updated periodically and/or in real time.

In the case that the transit information is updated periodically and/or in real time, a centralized information system may be used for communicating certain types of information to the plurality of information displays distributed about the transit service area.

Because it is advantageous for transit information displays to be flexible, that is to display information in a manner appropriate to the site and containing information relating to the site at which the information display is installed, there is a need for a system in which the appropriate information may be communicated to a specific transit information display. Further, there is a need for a system which allows a user to easily configure parameters relating to the transit information display and relating to the information to be displayed on the information display. Further, there is a need for a transit information display system that stores configuration information at each of the plurality of transit information displays distributed throughout the system in a flash memory without necessitating recompiling of an information receiving program running at the transit information display.

It would be desirable to provide a system and/or method that provides one or more of these or other advantageous features. Other features and advantages will be made apparent from the present specification. The teachings disclosed extend to those embodiments which fall within the scope of the appended claims, regardless of whether they accomplish one or more of the aforementioned needs.

SUMMARY

An exemplary embodiment relates to a time division multiple access (TDMA) based transit information display communications system having an information display. The information display includes an electronic display area, a microcontroller supported by the information display and coupled to the display. The information display also includes a radio frequency receiver coupled to the microcontroller and a memory coupled to the microcontroller. Further, the information display includes a program running on the microcontroller, the program being stored in the memory, the program being configured to display data on the display according to configuration data including an information display identification (ID) and the number of lines in the display.

Another exemplary embodiment relates to a transit information system including a central controller, a radio frequency transmitter in communication with the central controller, and a transit information display including. The transit information display includes a radio frequency receiver, a microcontroller, a memory coupled to the microcontroller, and a program stored in the memory and accessing configuration data. The configuration data includes an information display identification (ID) and the number of lines in the display.

Yet another exemplary embodiment relates to a transit information system including a central controller, a radio frequency transmitter in communication with the central controller, and a transit information display including. The transit information display includes a radio frequency receiver, a microcontroller, and a memory coupled to the microcontroller. Further, the transit information display includes a program stored in the memory and accessing configuration data. The configuration data includes an information display identification (ID) and the number of lines in the display. The configuration data is modifiable without requiring recompiling of the program.

Alternative exemplary embodiments relate to other features and combination of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF EXEMPLARY EMBODIMENTS

Figure 1:
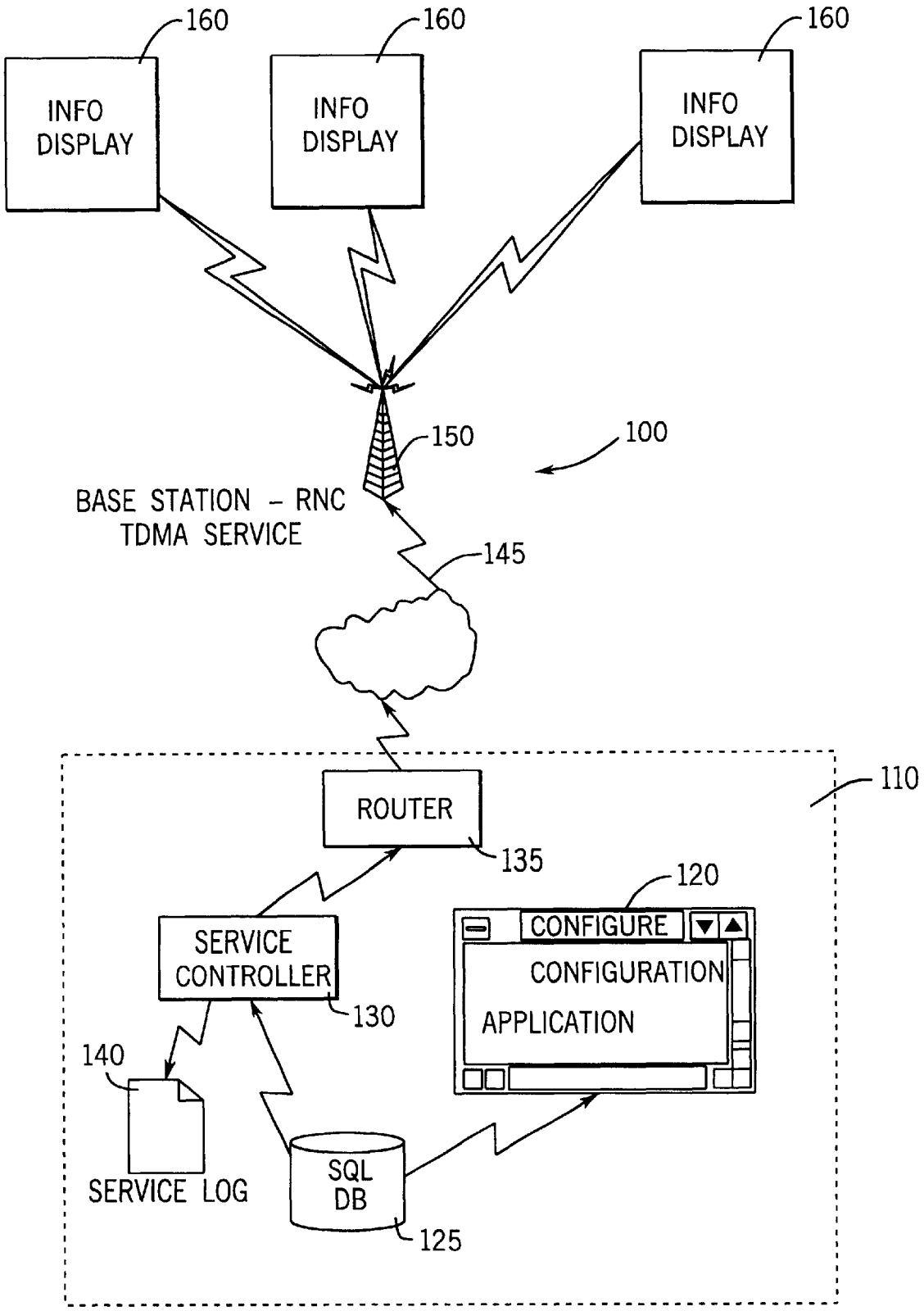
FIG. 1 is a block diagram depicting a transit information system including a configuration application.

Referring now to FIG. 1, a transit information system 100 is depicted. Transit information system 100 includes a central control system 110. Central control system 110 includes a configuration tool 120, a database 125, a service controller 130, a router 135, and a service log 140. Central control 110 may be configured on a single centralized computer system and/or a plurality of computers and other electronic devices. Service controller 130 provides messaging services via router 135 over a communications link 145 to a base station 150. Base station 150 is configured for radio frequency communications to a plurality of transit information displays or signs 160 which include radio frequency receivers, and in an alternative embodiment radio frequency transceivers. In further alternative embodiments, communications from central controller 100 may be made over a communications network to signs 160 through any of a variety of means including, but not limited to radio frequency technologies, optical communications technologies, and hardwired technologies. Signs 160 are configured to display a plurality of information relating to the departure and arrival of transit vehicles, such as, but not limited to busses, trains, and the like.

In an exemplary embodiment, central controller 110 maintains a service log 140 which keeps records of information relating to the transit system including information communicated to signs 160. Further, in an exemplary embodiment, configuration application 120 is used to define parameters for signs 160. The parameters of signs 160 include parameters which define and are used to modify the behavior of signs 160 and further to define and modify the information which is communicated to each of signs 160.

In operation, each sign 160 receives data messages radiated at the radio network controller (RNC) base station 150 through a time division multiple access (TDMA) process located at a tower site.

Service control 130 may query database 125 for a list of:

Routes and schedules

Time points

Active vehicles

Schedule adherence of the active vehicles

Route patterns for time points and route direction.

Service controller 130 then manages and organizes time points and vehicles, route block tracking within the configured adherence window of operation, and issues router 135 to send messages to the appropriate signs 160 within system 100. These messages are sent via router 135 and may include time updates, route information, and user messages among other information. Service control 130 may also log its activities to a text file (service log 140) or any other type of file, if configured to do so.

Service control 130 uses information established within configuration application 120 that is then stored in database 125 tables (tables may be stored in SQL format or any other applicable database format). Each sign 160 may include, as part of its configuration parameters, the following information among other possible information:

Sign name

Radio Network Identification (RNet ID)

Time point crossing

Routes to display on the sign

Arrival countdown timer for each route displayed on the sign

Direction filters for each route displayed on the sign

Instant (priority) user-defined messages

User-defined scheduled messages with begin and end times.

In an exemplary embodiment, a system administrator or qualified technician sets parameters within configuration application 120. Access to this application may be provided through any of a variety of operating system interfaces including but not limited to the Windows NT Start menu.

Figure 2:
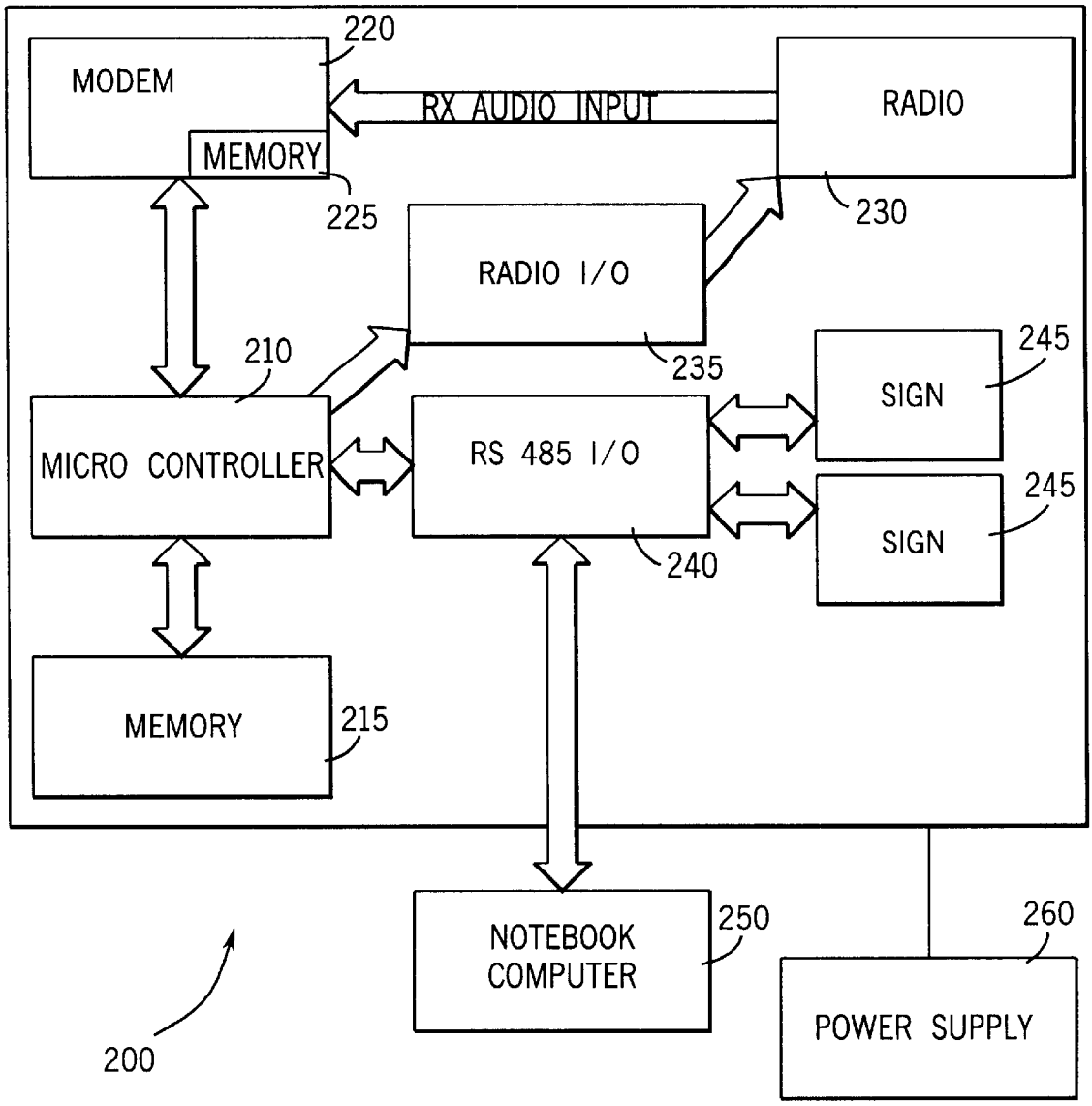
FIG. 2 is an exemplary block diagram of a transit information display system.

Referring now to FIG. 2, a transit information display unit or sign unit 200 is depicted. Sign 200 is representative of signs 160 in FIG. 1. Sign 200 includes a micro controller 210, a modem 220, a radio transmitter 230, a radio input output interface 235, and input output interface shown as an RS485 input output interface 240 and at least one electronic display area 245. RS485 I/O 240 may be coupled to any variety of input output devices such as but not limited to a notebook computer 250 by any of a variety of communications connections such as, but not limited to, a serial cable, a parallel cable, and/or an infrared port. Information display system 200 also includes a power supply 260 which may be an external and/or an internal power supply.

In an exemplary embodiment, radio 230 receives a signal from base station 150. The signal is communicated to the microcontrol 210 by a modem 220 if the communications signal is intended (addressed) for the particular information display. Microcontroller 210 then interprets the signal and provides information to be displayed on display areas 245 according to the communications signal. In an alternative exemplary embodiment, the radio I/O controller 235 may communicate information from system 200 to base station 150. Further, in an exemplary embodiment, display areas 245 may be any of a variety of display types, including, but not limited to LED type displays and the like. Further still, each system 200 may include a plurality of display areas 245. For example, a display system may include one to four display lines, however, such a system is not limited to any number of display lines. Further still, in an exemplary embodiment radio 230 and modem 220 are configured to receive and interpret time division multiple access (TDMA) communication signals. However, any variety of other communications protocols may be used without departing from the scope of the invention. For example, it may be desirable to utilize transmission control protocol/internet protocol (TCP/IP) or any of a variety of other protocols such as, but not limited to code division multiple access (CDMA) protocols.

In an exemplary embodiment notebook computer 250 may be configured to change configuration parameters on microcontroller 210, which may include a memory 215, to store such parameters. Such a memory may be a flash memory or any other type of appropriate memory.

In an exemplary embodiment each sign post may have one of four configurations: one, two, three, or four lines. Each configuration shall be capable of displaying current time, schedule information for up to ten routes and 3 user-definable messages. Signs may be configured in either standard or high brightness or any other configuration. Each sign face may be configured to display customer defined graphics.

The sign interface may be an RS-485 interface used on medium cost, high or low brite displays or an RS-232 interface used on low cost displays that don't support RS-485 addressing schemes.

In an exemplary embodiment there may be two radios available. A VHF radio may be a low cost data radio card. The sign control card (SCC) depicted as the electronics and/or any subset of the electronics for system 200 may configure this radio on power up to the correct frequency. A UHF radio may be used on both 800 and 900 Mhz TDMA networks. This radio may be pre-programmed at the factory to the correct receive frequency and requires no programming by the SCC. Both radios will operate in receive-only mode.

In an exemplary embodiment microcontroller has built-in ROM and RAM (memory 215). It may be responsible for decoding TDMA messages, sending messages to the sign(s), programming the VHF radio, configuring the SCC, programming the transit information software, and performing self test. Further microcontroller 210 talks to the sign(s) via RS485 I/O interface 240. The interface shall operate at 9600 bps. It may also be used to reprogram the modem flash software and configuration data stored in a memory 225 or in memory 215. Additionally, it may perform self test and report SCC status.

In a further exemplary embodiment the microcontroller 210 may initialize the VHF radio through radio I/O interface 235.

System 200 may, in an exemplary embodiment require a power supply capable of supplying 7.5 VDC and 5.0 VDC. This supply will also provide power for the sign display electronics. Any of a variety of other applicable power sources and configuration may also be used.

When system 200 is powered up, it does not have current schedule information from central controller 110. The SCC initializes each sign as follows (not limited to the following):

Send soft reset command to each sign to clear old information from the sign. Upon receiving the soft reset command, each sign displays current information such as sign software version, total sign memory, and the sign address.

Send configuration messages to each sign to initialize text and string files within each sign.

The sign may be configured to display information about the system 200 including but not limited to:

Sign powerup info

SCC Flash software version

SCC Boot software version

SCC selftest status.

Each component of power up information may be displayed for a period of time, scrolling off the display to be replaced by another component of powerup information. This shall continue for a period of time. After this period of time, the sign shall display the current time (initialized to 02:34 AM) until the sign receives route and user information from the central controller 110.

The SCC may initialize data radio receiver 230 through the radio I/O 235 port.

In a particularly preferred embodiment, each display system 200 may be configured in a different way depending on the number of signs within it. The correct configuration may be determined on system power up by the SCC based on the value of the configuration parameter, SignTypeCFG, in Flash memory. SignTypeCFG may have, but not limited to, four values: SINGLE_LINE_SIGN, TWO_LINE_SIGN, THREE_LINE_SIGN, and FOUR_LINE_SIGN. The signs may be automatically configured based on the SignTypeCFG parameter.

Multiline sign configurations may be problematic unless properly dealt with because each sign may be configured with a separate microcontroller within it and they all run asynchronously with no means of synchronizing the signs together. Thus, at some point during the day, it may be possible to have route 1 data displayed on line 1 and route 5 data displayed on line 2 and route 7 data displayed on line 3. Therefore, it is desirable for the SCC to implement a sign control/sign run sequence manager so that the SCC has a tight control over what data is presented on each sign at all times.

In a particularly preferred embodiment, the general methodology for multi-line signs may be, but is not limited to, the following:

1. Load all text and string files into the sign as they come over the air (SCC doesn't need to store strings, lower memory requirements).
2. SCC employs Run Sequence Manager.
3. SCC keeps track of mode (time & user mode or route mode) and switches appropriately.
4. Ex: display only time and user msgs (if any) if no routes active.
5. Run Sequence Manager sorts & displays routes by earliest to latest depart time.
6. In route mode, each line will receive a new run sequence which is only one file long.
7. Can't have multiple files in run sequence because signs will get out of sync with each other.
8. Run sequence on signs need to match.

In an exemplary embodiment a one line sign may be used. If a one line sign is used information is sequentially scrolled on and off the sign until all the information has been displayed and then repeated.

If a two line sign is used, a particular exemplary embodiment displays current time and route on line 1 and displays User Messages, Destination and Depart Time on line 2.

In the case that a three line sign is used, the sign may be configured to display Current time and Route on line 1, display Destination and User Messages on line 2 and display Date and Depart Time on line 3.

Further in the case that a four line sign is used, the sign may be configured to display Current Time and all User Messages on Line 1, Display Route msg on line 2, display Destination msg on line 3, and display Depart Time msg on line 4.

For the caseset a one line, two line, three line, or four line sign, any of a variety of information configurations may alternatively be used, not limited to the configurations provided above.

In a particularly preferred embodiment, each system 200 must be configured properly for its location. 128 bytes of configuration data may be reserved starting at an address such as but not limited to OxFE00. Configuration data may be stored in flash memory and may be programmed and read from RS-485 I/O interface 240 on the SCC. Configuration data may include:

| | |
|---|---|
| Byte ScrambleEnableCGF = | FALSE; -- (Modern Scramble on/off |
| Byte RxDataInvertCFG = | YES; - (Is signal invested? |
| Byte RxNumPktsCFG = | 2; - (packets/slots) |
| Byte SlotTime = | 120; - (in milliseconds) |
| Byte SignIDLowCFG = | 0×7B; (sign id low byte) |
| Byte SignIDHighCFG = | 0×F1; (sign high low byte) |
| Byte SignTypeCFG = | SINGLE_LINE_SIGN; (sign type) |
| Byte [4] RadioRxFreqCFG = | 464500000; (radio receiver frequency) |

The above values are current defaults. Defaults may be easily modified. Additional configuration items may be easily added.

In an exemplary embodiment, the modem software may perform the following functions:

1. Process all received messages from TDMA network.
2. Decode only messages addressed to this sign—broadcast or specifically addressed to the specific system 200 ID.
3. Send message addressed to this device to the sign for display.

Further, in an exemplary embodiment TDMA is configured to transmit 2 download packets per message. Each packet may be configured as 18 bytes. The first 4 bytes of the first 18-byte packet is used for message control. The message format may be defined but is not limited as follows:

| | |
|---|---|
| 1 byte | device address-low byte |
| 1 byte | device address-high byte |
| 1 byte | Flags |
| 1 byte | NP, NR |
| 14 bytes | data-first packet |
| 18 bytes | data-second packet |

In an alternative TDMA system, device address may be defined but is not limited as follows:

bit 15 thru bit 11 Agency_Type (for MCC control)

Bit 10 thru bit 0 Device_ID address up to 2047 devices

The Agency_Type may be set by the customer.

Each device may have a unique Device_ID.

Device_ID=0 may be defined as broadcast message, sent to all devices of that Agency_Type.

Agency_Type may not be defined for Gen 1 TDMA, thus 65535 devices may be addressed.

Flags Byte may be defined as follows:

| | | |
|---|---|---|
| Bit 7 | Transport Type 0 = | Datagram, 1 = Reliable |
| Bit 6-5 | End Flag | 2 = Starting packet<br>0 = Middle packet<br>1 = End packet<br>3 = Only packet of this message |
| Bit 4 | More to Come Flag | not set by RNC, only set by remote devices |
| Bit 3 | Is Control Message | 0 = data message<br>1 = control message |
| Bit 2 | Is Asynchronous | not set by RNC |
| Bit 1-0 | Priority | {set by remote devices} |

NP/NR Byte is defined as follows:

| | |
|---|---|
| NP = Number of packet being sent (increments to 0 after 15) | |
| NR = Next Packet expected from the sender | |
| Bit 7-4 | NP |
| Bit 3-0 NR | |

Further still, in a particularly preferred embodiment User Messages are defined by the customer using an application at the central controller 110. Each display system 200 may display up to three user messages.

The message format for User Messages may be defined as follows:

| | | |
|---|---|---|
| Byte 1–4 | Msg_Header | |
| byte 5 | Msg_Name | 0 × E4 = sign User Message |
| byte 6 | Msg_Number | |
| byte 7 | Display_Position | for multiline signs, which line |
| byte 8 | Mode_Code | Standard sign modes |
| byte 9 | Special_Specifier | Special sign modes |
| byte 10–18 | User Message-Block 1 | –27 chars for first msg block |
| byte 19–36 | User Message-Block 1 | (message continued in second packet) |
| Byte 1–4 | Msg_Header | |
| byte 5 | Msg_Name | 0 × E4 = sign User Message |
| byte 6 | Msg_Number | |
| byte 7–36 | User_Message-Block 2 | |
| Byte 1–4 | Msg_Header | |
| byte 5 | Msg_Name | 0 × E4 = sign User Message |
| byte 6 | Msg_Number | |
| byte 7–36 | User_Message-Block 3 | |
| Byte 1–4 | Msg_Header | |
| byte 5 | Msg_Name | 0 × E4 = sign User Message |
| byte 6 | Msg_Number | |
| byte 7–36 | User_Message-Block 4 | |

27 chars + 30 chars * 3 blocks = 117 chars maximum per user message

Similarly, a time message format may be defined as follows:

| | | |
|---|---|---|
| Byte 1–4 | Msg_Header | |
| byte 5 | Msg_Name | 0 × EO = Sign Time Info Message |
| byte 6–9 | Current_Time | Seconds past midnight (low byte, high byte) |
| byte 10 | Day_of_Week | '1' = Sunday, '7' = Saturday |
| byte 11 | Month_Tens | ascii where '1' = 0 × 30 |
| byte 12 | Month_Ones | |
| byte 13 | Day_Tens | |
| byte 14 | Day_Ones | |
| byte 15 | Year_Tens | |
| byte 16 | Year_Ones | |
| byte 17 | Hours_Tens | |
| byte 18 | Hours_Ones | |
| byte 19 | Minutes_Tens | |
| byte 20 | Minutes_Ones | |
| byte 21 | Time_Format | 'S' = am/pm, 'M' = 24 hour format |

Also similarly a route information message format may be defined as follows:

| | | |
|---|---|---|
| Byte 1–4 | Msg_Header | |
| byte 5 | Msg_Name | 0 × E3 = sign Route String message |
| byte 6 | Buffer_Id | 1 to 10 |
| byte 7 | Route_File | 'A"to "J" |
| byte 8 | Destination_File | 'a'to 'j' |
| byte 9–10 | Schedule_Time | minutes past midnight, 0 to 1440 |
| byte 11 | Adherence | plus or minus minutes |

Further similarly, a route string information message format may be defined as follows:

| | | |
|---|---|---|
| Byte 1–4 | Msg_Header | |
| byte 5 | Msg_Name | 0 × E1 = sign Route String Info message |
| byte 6 | Filename | 'A' to 'J' |
| byte 7–36 | New_String | ascii characters |

Further still similarly, a destination string information message format may be defined as follows:

| | | |
|---|---|---|
| Byte 1–4 | Msg_Header | |
| byte 5 | Msg_Name | 0 × E2 = sign Destination String message |
| byte 6 | Filename | 'a' to 'j' |
| byte 7–36 | New_String | ascii characters |

In an exemplary embodiment a toolkit allows users to program, configure, and test the system 200 through a program running on a PC using a standard Windows interface such as but not limited to notebook computer 250. A Main menu may allow a user to select various tests, program system 200, configure system 200 and perform self tests. The toolkit may allow checksum verification. The toolkit may also allow entry of Flash Address and display 128 bytes (one flash sector) of code. Further, the toolkit program may enable the selection of configuration parameters (as discussed previously) and save them to a file. Further still, the toolkit may enable the selection of a file and sending of new configurations to System 200 (program configuration area of flash). Yet further still, the toolkit program may enable the sending of a query to System 200 to read its current configuration and may enable the Display of the configuration. Yet further still, the toolkit program may allow a self test program which may carry out the following:

1. Run Selftest and display Test Status.
2. Get software versions for the transit information and Boot software. Display versions.
3. Calculate checksums for the transit information and Boot software. Display checksums.

Yet still further, the toolkit may enable the changing of a specific sign address. Only one sign at a time can be connected to the SCC for the programming process.

While the detailed drawings, specific examples and particular formulations given describe preferred and exemplary embodiments, they serve the purpose of illustration only. The inventions disclosed are not limited to the specific forms shown. For example, the methods may be performed in any of a variety of sequence of steps. The hardware and software configurations shown and described may differ depending on the chosen performance characteristics and physical characteristics of the computing devices. For example, the type of computing device, communications bus, or processor used may differ. The systems and methods depicted and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. A time division multiple access (TDMA) based transit information display communications system having an information display, the information display comprising:

an electronic display area;

a microcontroller supported by the information display and coupled to the display;

a radio frequency receiver coupled to the microcontroller;

a memory coupled to the microcontroller; and a program running on the microcontroller, the program being stored in the memory, the program being configured to display data on the display according to configuration data including an information display identification (ID) and the number of lines in the display.

2. The information display of claim 1, wherein the data is displayed according to a color control parameter.

3. The information display of claim 1, wherein at least a portion of the memory is a flash memory.

4. The information display of claim 3, wherein the configuration data is stored in the flash memory.

5. The information display of claim 1, wherein the configuration data includes slot time data.

6. The information display of claim 1, wherein the configuration data includes sign type data.

7. The information display of claim 1, wherein the configuration data includes radio frequency receiver frequency data.

8. The information display of claim 1, further comprising:

an input output port coupled to the microcontroller, the input output port configured to be used to enable the modification of the configuration data.

9. The information display of claim 8, wherein the input output port is an infrared port.

10. A transit information system, comprising:

a central controller;

a radio frequency transmitter in communication with the central controller;

a transit information display including, a radio frequency receiver, a microcontroller, a memory coupled to the microcontroller, and a program stored in the memory and accessing configuration data, the configuration data including an information display identification (ID) and the number of lines in the display.

11. The transit information system of claim 10, wherein the transit information display is a bus system information display.

12. The transit information system of claim 10, wherein the transit information display is a train system information display.

13. The transit information system of claim 10, wherein the data is displayed according to a color control parameter.

14. The transit information system of claim 10, wherein at least a portion of the memory is a flash memory.

15. The transit information system of claim 14, wherein the configuration data is stored in the flash memory.

16. The transit information system of claim 10, wherein the configuration data includes slot time data.

17. The transit information system of claim 10, wherein the configuration data includes sign type data.

18. The transit information system of claim 10, wherein the configuration data includes radio frequency receiver frequency data.

19. The transit information system of claim 10, further comprising:

an input output port coupled to the microcontroller, the input output port configured to be used to enable the modification of the configuration data.

20. The transit information system of claim 19, wherein the input output port is an infrared port.

21. A transit information system, comprising:

a central controller;

a radio frequency transmitter in communication with the central controller;

a transit information display including, a radio frequency receiver, a microcontroller, a memory coupled to the microcontroller, and a program stored in the memory and accessing configuration data, the configuration data including an information display identification (ID) and the number of lines in the display, the configuration data being modifiable without requiring recompiling of the program.

22. The transit information system of claim 21, wherein the transit information display is a bus system information display.

23. The transit information system of claim 21, wherein the transit information display is a train system information display.

24. The transit information system of claim 21, wherein the data is displayed according to a color control parameter.

25. The transit information system of claim 21, wherein at least a portion of the memory is a flash memory.

26. The transit information system of claim 25, wherein the configuration data is stored in the flash memory.

27. The transit information system of claim 21, wherein the configuration data includes slot time data.

28. The transit information system of claim 21, wherein the configuration data includes sign type data.

29. The transit information system of claim 21, wherein the configuration data includes radio frequency receiver frequency data.

30. The transit information system of claim 21, further comprising:

an input output port coupled to the microcontroller, the input output port configured to be used to enable the modification of the configuration data.

31. The transit information system of claim 30, wherein the input output port is an infrared port.

* * * * *